United States Patent [19]

Buckner

[11] 4,030,489

[45] June 21, 1977

[54] TRACTION APPARATUS

[76] Inventor: William L. Buckner, Rte. 2, Sanford, N.C. 27330

[22] Filed: Sept. 17, 1975

[21] Appl. No.: 614,133

[52] U.S. Cl. ..... 128/75

[51] Int. Cl.[2] ..... A61H 1/02

[58] Field of Search ..... 128/75, 78, 71, 84 C, 128/69, 70

[56] References Cited

UNITED STATES PATENTS

| | | | |
|---|---|---|---|
| 3,167,068 | 1/1965 | Carr | 128/75 |
| 3,548,817 | 12/1970 | Mittasch | 128/75 |
| 3,675,646 | 7/1972 | Corcoran | 128/75 |
| 3,716,049 | 2/1973 | Kaplan | 128/75 |
| 3,827,429 | 8/1974 | Heikes | 128/75 |

*Primary Examiner*—John D. Yasko

[57] ABSTRACT

A portable lumbo-sacral traction apparatus having a U-shaped supporting frame, a suspension belt adapted to be worn around the lower thoracic region of the patient and means releasably securing the suspension belt to the U-shaped frame so that the frame applies upward force to the belt to remove weight from the lower lumbo-sacral and pelvic regions of a patient when a patient is being acted upon by the apparatus.

10 Claims, 5 Drawing Figures

TRACTION APPARATUS

BACKGROUND, BRIEF SUMMARY AND OBJECTIVES OF THE INVENTION

This invention relates to traction devices generally and more particularly to a traction apparatus which enables the removal of body weight from the lower lumbo-sacral region of the body.

Existing devices for providing traction or minimizing compressive forces on the bone structure in the lumbar, sacral, or pelvic region, while effective, require the patient to be hospitalized or at least confined to a bed or some otherwise rather restrictive device that limits the patient in performing productive functions or other normal activities. Moreover, the recovery period is long and tedious; and the patient is often tempted to return too quickly to normal activities and thereby risk restrain and a return to traction.

Other traction devices such as that shown in U.S. Pat. No. 3,167,068 provide a patient with means to enable him to perform productive functions or otherwise engage in normal seated activities. Even using such apparatus, the patient is still somewhat restrained since he must remain in a relatively permanent, seated position so long as traction is being applied.

The present invention is designed to provide a novel and relatively simple and inexpensive traction apparatus for applying traction or removing the body weight from the lower lumbo-sacral region of the body in a manner which permits the patient to be comfortably seated and relatively unrestrained and, more importantly, to walk and move from place to place while wearing the apparatus so as to allow him to perform a wide variety of productive functions and even engage in his normal occupational requirements.

In a typical embodiment of the invention, a patient is provided with a free-standing U-shaped supporting frame to which is attached a suspension belt adapted to be worn about the lower thoracic region. The belt is adjustably securable to the frame by appropriate means and includes at least one pre-shaped encircling member adapted to extend completely around the lower thoracic region and a cushioning pad contiguous therewith which provides comfortable contact with the body and is adapted to surround at least partially the lower thoracic region. The U-shaped supporting frame has a connecting segment and upstanding legs which may be adjustable therewith to enable varying degrees of tension when a patient is acted upon by the apparatus.

From the previous background description and brief summary of the invention, it is apparent that a primary object is to provide a novel, relatively simple, and inexpensive traction system for applying traction or removing the body weight from the lower-sacral region of the patient which permits the patient to move freely from place to place and carry on normal personal or occupational activities during weight removal or the application of traction.

Another object of the present invention is to provide a traction apparatus that permits the patient to rapidly and conveniently adjust the amount of traction provided.

Still another object of the present invention is to provide a traction apparatus that is specifically designed for comfortable use by the patient in a seated operable position.

Other objects, advantages, and features of the invention will appear as it is described in further detail in connection with the accompanying drawings wherein like characters of reference designate like parts throughout the several views.

FIGURE DESCRIPTION

DETAILED DESCRIPTION OF THE INVENTION

Figure 1:
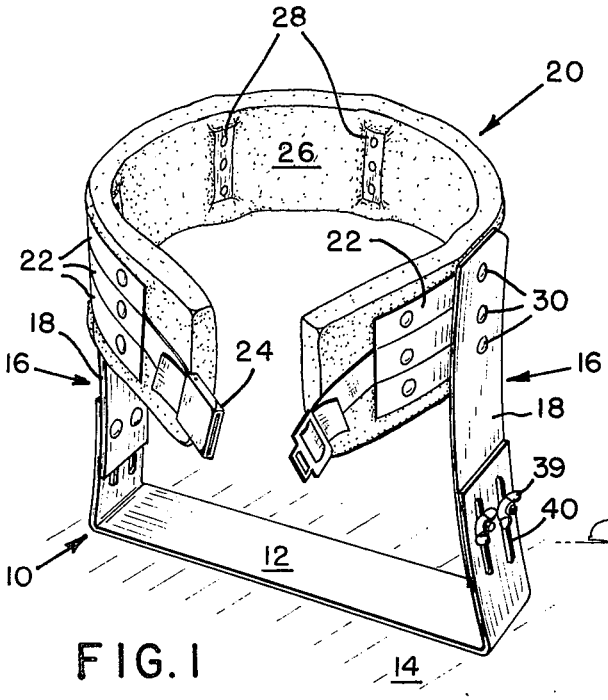
FIG. 1 is a perspective view of one embodiment of the present invention showing the U-shaped supporting frame supporting the suspension belt which is adapted to be worn around the lower thoracic region of a patient.

Referring now to the drawings and particularly to FIG. 1, a free-standing U-shaped supporting frame shown generally as 10 is comprised of a connecting segment 12 which is substantially flat to enable uniform and even contact with the supporting surface 14 and upstanding legs shown generally as 16 extending from connecting segment 12 upwardly as shown. Legs 16 may be integral with connecting segment 12 or separate therefrom as shown in FIG. 1 whereby extensions 18 are adjustably and releasably secured to connecting segment 12 by bolts and cooperating slots or by other suitable securing means. The embodiment shown in FIG. 1 enables the adjustment of traction for the patient by removably securing extensions 18 in a desired relationship with connecting segment 12.

The U-shaped frame 10 carries a suspension belt shown generally as 20 which is adapted to be worn around the lower thoracic region of a patient. The belt embodiment shown in FIG. 1 includes three pre-shaped encircling members, a securing device, in this case a belt 24 and buckle, for releasably securing the encircling members in place, a cushioning pad 26 contiguous with the encircling members and adapted to at least partially encircle the lower thoracic region of a patient, and suitable means for joining the encircling means to the cushioning pad, in this case a plurality of flexible clamps 28 (leather) rigidly bonding the components together.

Figure 3:
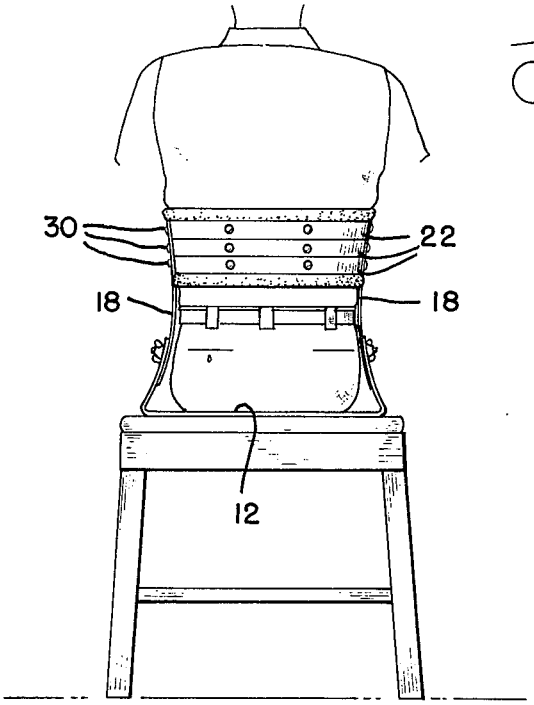
FIG. 3 is a rear elevational view of the traction apparatus embodiment of FIG. 1 engaging the lower thoracic region of a patient.
Figure 4:
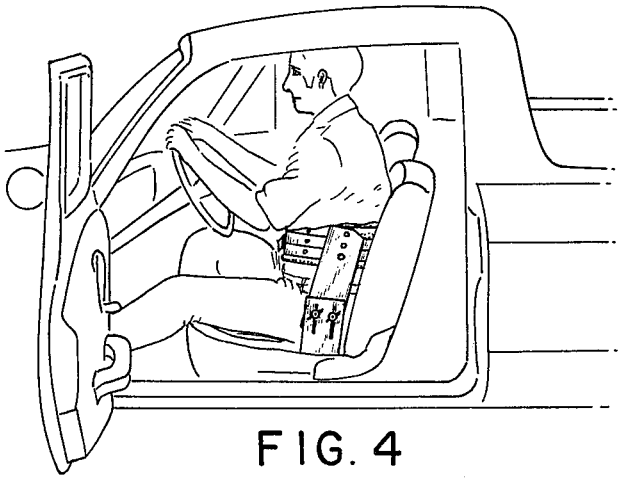
FIG. 4 is a perspective view of a patient wearing the traction apparatus of FIG. 1 while performing normal driving functions.

The U-shaped frame and the suspension belt are joined together by screws 30 or other appropriate elements to enable positive but releasable securement one with the other. The upstanding legs are arcuately shaped and extend upwardly to uniformly engage the hip, waist, and lower chest region of a patient such as shown in FIG. 3. Articulate upstanding legs 18 as shown in FIG. 1 enable immediate adjustment to move connecting segment 12 out of action and permit a patient to walk and move about while the suspension belt still encircles the lower thoracic region. Adjustments of screws 30 will similarly release the U-shaped frame from action when it is necessary for the patient to walk and move freely about. However, a patient may move from time to time in limited manner without releasing the U-shaped member.

Figure 2:
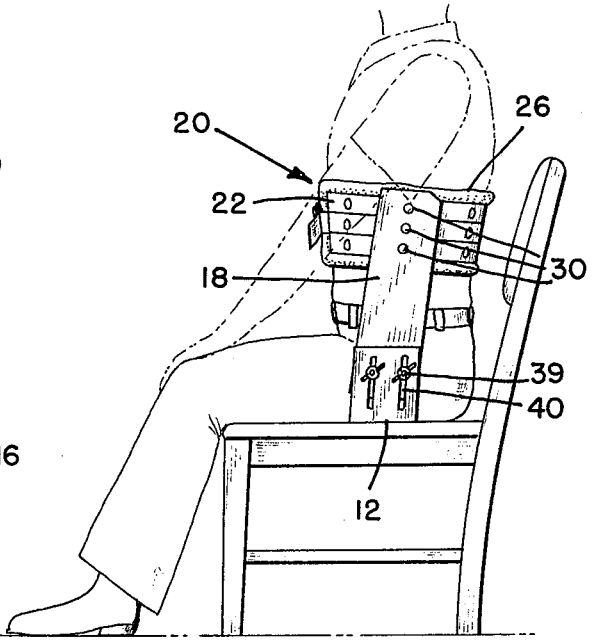
FIG. 2 is a side elevational view of the embodiment of the present invention shown in FIG. 1 illustrating the positioning of the traction apparatus with respect to the lower thoracic region of a patient.

When the traction apparatus is used by a patient, the U-shaped frame applies upward tension to suspension belt 20 to remove weight from the lower lumbo-sacral and pelvic regions of a patient when the patient assumes a sitting position and thereby is being acted upon by the apparatus. The use of the present invention by a patient as in FIGS. 2 and 3 illustrates this action. From this use it is apparent that tension may be varied by the proper adjustment of screws 30 or the bolts 39 and slots 40 securing the articulate upstanding legs 18 to connecting segment 12.

Figure 5:
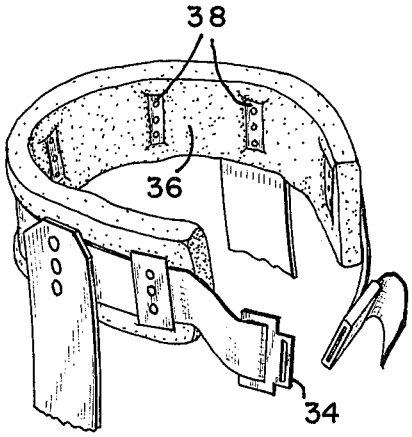
FIG. 5 is another embodiment of the traction apparatus of the present invention utilizing a flexible, pre-shaped encircling member.

While the embodiment reflected in FIGS. 1, 2, and 3 of the drawings utilizes three pre-shaped and rigid encircling members adapted to extend around the lower thoracic region of a patient, the alternate embodiment illustrated in FIG. 5 includes a single pre-shaped and somewhat flexible encircling member adapted to extend completely around the lower thoracic region of a patient and being securable by an appropriate positive latching clasp 34. A cushioning pad 36 is utilized in this embodiment and is fastened to the flexible encircling member by appropriate latches 38. This embodiment enables the traction apparatus to be extremely light and yet sufficiently substantial to provide the necessary traction to the patient. This embodiment is also significantly less expensive to fabricate since the use of a single flexible member in lieu of one or more pre-shaped rigid and usually metallic members is a significant cost saving.

It will be obvious to those skilled in the art, upon studying this disclosure, that certain variations and modifications are possible and hence may be embodied in structures other than those particularly disclosed herein by way of example, within the sphere and scope of the invention as defined in the following claims.

I claim:

1. A portable lumbo-sacral traction apparatus comprising: a free-standing integrally formed U-shaped supporting frame; a suspension belt adapted to be worn around the lower thoracic region of a patient rigidly and releasably secured to such frame, said belt including at least one pre-shaped encircling member adapted to extend substantially completely around the lower thoracic region of a patient, means for releasably securing said encircling member about the lower thoracic region of a patient, a cushioning pad contiguous with said encircling member and adapted to at least partially encircle the lower thoracic region of a patient with said encircling member, and means joining said encircling member to said cushioning pad; and means releasably securing said suspension belt to said U-shaped frame whereby the U-shaped frame applies upward tension to the suspension belt to remove weight from the lower lumbo-sacral and pelvic regions of a patient when a patient is being acted upon by the apparatus.

2. The apparatus as claimed in claim 1 wherein the U-shaped frame has a connecting segment with a link substantially the width of the hips of a patient and upstanding legs of a length less than the length of the connecting segment.

3. The apparatus as claimed in claim 1 wherein said suspension belt further includes means for securing said cushioning pad at least partially about the lower thoracic region of a patient, and said U-shaped member is substantially uniform in thickness and in width.

4. The apparatus as claimed in claim 1 wherein said suspension belt pre-shaped encircling member is substantially rigid.

5. The apparatus as claimed in claim 2 wherein said frame connecting member is substantially flat to enable uniform contact with the supporting surface.

6. The apparatus as claimed in claim 5 wherein said suspension belt further includes means for securing said cushioning pad at least partially about the lower thoracic region of a patient and the supporting frame and connected suspension belt are movable with respect to each other to enable a patient to walk and move about while the suspension belt is encircling the lower thoracic region.

7. The apparatus as claimed in claim 2 wherein the frame upstanding legs are adjustable with and releasably securable to said connecting segment to enable an adjustable application of force when a patient is acted upon by the apparatus.

8. The apparatus as claimed in claim 5 wherein the frame upstanding legs are adjustable with and releasably securable to said connecting segment to enable an adjustable application of tension when a patient is acted upon by the apparatus.

9. The apparatus as claimed in claim 8 wherein said suspension belt pre-shaped encircling member is substantially rigid.

10. The apparatus as claimed in claim 9 wherein the supporting frame upstanding legs are arcuately shaped and extend upwardly to uniformly engage the hip, waist, and lower chest regions of patient.

* * * * *